US012778374B2

(12) United States Patent
Hong

(10) Patent No.: US 12,778,374 B2
(45) Date of Patent: Nov. 3, 2026

(54) MOP CAPABLE OF FIXING MOPPING CLOTH BY PUSH AND PULL

(71) Applicant: HANGZHOU JOYSING IMP & EXP CO., LTD, Hangzhou (CN)

(72) Inventor: Xing Hong, Hangzhou (CN)

(73) Assignee: HANGZHOU JOYSING IMP&EXP CO., LTD, Hangzhou (CN)

( * ) Notice: Subject to any disclaimer, the term of this patent is extended or adjusted under 35 U.S.C. 154(b) by 216 days.

(21) Appl. No.: 18/948,721

(22) Filed: Nov. 15, 2024

(65) Prior Publication Data

US 2025/0072699 A1 Mar. 6, 2025

(30) Foreign Application Priority Data

Nov. 4, 2024 (CN) ..... 202422676293.7

(51) Int. Cl.
*A47L 13/256* (2006.01)

(52) U.S. Cl.
CPC ..... *A47L 13/256* (2013.01)

(58) Field of Classification Search
CPC ..... A47L 13/256; A47L 13/24; A47L 13/252; A47L 13/253; A47L 13/254; A47L 13/258; A47L 13/44; A47L 13/48; A47L 13/46; A47L 25/06; A47L 25/08; A47L 9/0673; A47L 9/0666; A47L 13/146; A47L 13/12; A46B 5/0054; A46B 17/02; B08B 13/00; B08B 1/14
See application file for complete search history.

(56) References Cited

U.S. PATENT DOCUMENTS 2,044,075 A * 6/1936 Jelenfy ..... A47L 13/146 15/119.2
2,663,042 A * 12/1953 Richards ..... A47L 13/257 15/147.2
2,730,743 A * 1/1956 Zottola ..... A47L 13/146 15/116.2
2,834,974 A * 5/1958 Greenleaf ..... A47L 13/146 15/119.2
2,932,049 A * 4/1960 Jenkins ..... A47L 13/257 15/152
2,955,311 A * 10/1960 Jurkanis ..... A47L 13/257 401/203
2,961,676 A * 11/1960 Chester ..... A47L 13/146 15/119.2

(Continued)

FOREIGN PATENT DOCUMENTS

CN 210446926 U * 5/2020
CN 111839385 A * 10/2020 ..... A47L 13/258
DE 4329848 A1 * 3/1994 ..... A47L 13/254

*Primary Examiner* — Monica L Perry
(74) *Attorney, Agent, or Firm* — Hemisphere Law, PLLC

(57) ABSTRACT

A mop capable of fixing mopping cloth by push and pull is provided. By arrangement of a protection frame, an inner wall groove, a movable column, elliptical holes, an outer convex bar, a column body with an elliptical section, and a helical twisted part, when a mop rod is manually extended downwards to drive the movable column to move downwards, a connecting column with an I-shaped section can be driven to rotate, so that two sliding plates are spliced with a middle plastic plate under the action of a sliding plate transmission structure; and after the splicing, mutually staggered flange teeth and plastic plate edge teeth clamp the mopping cloth.

6 Claims, 7 Drawing Sheets

(56) References Cited

U.S. PATENT DOCUMENTS 3,324,495 A * 6/1967 Schwartz ..... A47L 13/253 15/147.2
5,131,111 A * 7/1992 Richardson ..... A47L 13/258 15/119.1
5,253,387 A * 10/1993 Kresse ..... A47L 13/258 15/228
5,390,390 A * 2/1995 Kresse ..... A47L 13/258 15/228
5,553,344 A * 9/1996 Rosenkrantz ..... A47L 13/00 15/104.002
5,937,471 A * 8/1999 Liao ..... A47L 13/12 15/228
6,370,725 B1 * 4/2002 Carlson ..... B25G 3/38 15/119.2
6,804,853 B2 * 10/2004 Wang ..... A47L 13/12 15/245
7,690,069 B2 * 4/2010 Chen ..... A47L 13/22 15/228
7,802,340 B2 * 9/2010 Knopow ..... A47L 13/24 15/229.8
8,464,391 B2 * 6/2013 Bober ..... A47L 13/258 15/228
D719,712 S * 12/2014 Widmer ..... A46B 17/00 D32/35
8,959,699 B2 * 2/2015 Bober ..... A47L 13/254 15/228
12,064,071 B2 * 8/2024 Southall ..... A47L 13/24
2002/0174502 A1 * 11/2002 Cioci ..... A47L 13/258 15/119.2
2005/0091775 A1 * 5/2005 Lindholm ..... A47L 13/258 15/228
2006/0016038 A1 1/2006 Damrath et al.
2007/0022553 A1 * 2/2007 Niemeyer ..... A47L 13/58 15/228
2009/0139041 A1 * 6/2009 Weis ..... A47L 13/146 15/119.2
2009/0158542 A1 6/2009 Noble
2011/0185523 A1 8/2011 Chen

* cited by examiner

MOP CAPABLE OF FIXING MOPPING CLOTH BY PUSH AND PULL

TECHNICAL FIELD

The present disclosure relates to the technical field of cleaning tools, and in particular, to a mop capable of fixing mopping cloth by push and pull.

BACKGROUND

Mops, as common cleaning tools, can clean both a floor and a wall. The mops are widely used in household cleaning. Traditional mops with cloth strips are phased out with the continuous development and innovation of tools. At present, the most common mop usually includes a rod body and a plate body that cooperates with the rod body. The plate body has a hook and loop fastener that is used for bonding an entire piece of mopping cloth for use.

In a bonding mounting method using the hook and loop fastener, the mopping cloth needs to be cleaned after being used, so that the mopping cloth needs to be frequently removed for ease of cleaning. Due to the frequent removal, the bonding effect of the hook and loop fastener for mounting gradually decreases, and this affects a subsequent use effect.

SUMMARY

In view of the problems in the prior art, the present disclosure provides a mop capable of fixing mopping cloth by push and pull. A technical solution used includes a mop rod, and includes a bottom plate, several convex bars, several assembling heads, a plastic plate, several assembling holes, plastic plate edge teeth, sliding plates, sliding plate penetrating slots, steadying plates, steadying slots, outer edge flanges, flange teeth, a sliding plate transmission structure, a connecting column with an I-shaped section, a through hole, two upper fixed plates, a U-shaped frame, a fixed plate I, a matching connecting plate, a fixed plate II, a movable column limiting disk, a protection frame, an up-down steadying part, a movable column, elliptical holes, a column body with an elliptical section, and a helical twisted part. The several convex bars are distributed on a lower surface of the bottom plate; the convex bars are integrally formed with the several assembling heads made of hard plastic; the plastic plate is mounted in a matched manner with the assembling heads through the several assembling holes penetrating through the plastic plate; and an outer diameter of each assembling head is greater than a hole diameter of each assembling hole. After the assembling heads are inserted into the assembling holes, a configuration hole for the plastic plate may deform to achieve splicing between the plastic plate and the assembling heads. The plastic plate edge teeth are integrally formed on side surfaces of the plastic plate. The sliding plates are movably arranged below the bottom plate; the steadying plates are fixed on the convex bars; the steplike steadying slots are provided in the sliding chutes; the steadying plates are inserted in a matched manner into the steplike steadying slots; the outer edge flanges are fixed on bottom surfaces, close to outer sides, of the sliding plates; the flange teeth are distributed on inner side surfaces of the outer edge flanges; and the flange teeth are staggered from the plastic plate edge teeth. When the two sliding plates approach the plastic plate for splicing, the flange teeth are spliced with the plastic plate edge teeth to clamp the mopping cloth. The sliding plate transmission structure is arranged on inner sides of the sliding plates; the sliding plate transmission structure is mounted in a matched manner on a bottom surface of the connecting column with the I-shaped section which is mounted in a matched manner in the through hole of the bottom plate; the two upper fixed plates are fixed on the bottom plate; front and rear side walls of the U-shaped frames are rotatably connected to the upper fixed plates; left and right side walls of the U-shaped frames are rotatably connected to the protection frame; and the fixed plate I is integrally formed on the connecting column with the I-shaped section. The matching connecting plate is provided with open slots in upper and lower ends; an upper end of the fixed plate I is arranged in the open slot in the lower end of the matching connecting plate and is rotatably connected into the slot; a lower end of the fixed plate II is arranged in the open slot in the upper end of the matching connecting plate and is rotatably connected into the slot; the movable column limiting disk is fixed at an upper end of the fixed plate II; the movable column and the protection frame are mounted in a matched manner through the up-down steadying part; and the elliptical holes communicated to each other are provided in the mop rod and the movable column. The column body with the elliptical section is fixed on the movable column limiting disk; and a lower half part of the column body with the elliptical section is the helical twisted part, so that an upper elliptical end surface of the column body with the elliptical section and a lower elliptical end surface of the column body with the elliptical section form an angle of 90 degrees. Since the up-down steadying part is provided between the movable column and the protection frame, the movable column can move up and down only. An inner wall of the elliptical hole of the movable column is in contact with an outer wall of the column body with the elliptical section, so that the column body with the elliptical section may rotate when the movable column continuously moves downwards and passes through the helical twisted part. When the column body with the elliptical section rotates, the movable column limiting disk, the fixed plate I, the matching connecting plate, and the fixed plate II which are located below the column body with the elliptical section rotate together with the column body with the elliptical section, so that the connecting column with the I-shaped section drives the sliding plate transmission structure to operate, to drive the two sliding plates to approach each other. The mopping cloth is compressed by manually pressing the sliding plates and the plastic plate. When the sliding plates approach the plastic plate, the flange teeth and the plastic plate edge teeth are used to clamp the mopping cloth. When the movable column is operated reversely, the sliding plates can move outwards to release the used mopping cloth. It is convenient for cleaning.

In a preferred technical solution of the present disclosure, antislip slots are distributed on the plastic plate.

In a preferred technical solution of the present disclosure, the sliding plate transmission structure includes L-shaped protection plates, transmission matching plates, toothed bars, and gears; the L-shaped protection plates and the transmission matching plates are integrally formed on the inner sides of the sliding plates; a position of the L-shaped protection plate on a left side corresponds to a position of the transmission matching plate on a right side, and a position of the L-shaped protection plate on the right side corresponds to a position of the transmission matching plate on the left side; the transmission matching plates can extend into openings of the L-shaped protection plates; the toothed bars are integrally formed on upper surfaces of the transmission matching plates; the two toothed bars are meshed with the gears; and a lower end of the connecting column with the I-shaped section is fixedly connected to the gears. When the gears rotate together with the rotation of the connecting column with the I-shaped section, the two toothed bars meshed with the gears may move in an opposite direction. Meanwhile, during the outwards movement, the sliding plates where the toothed bars are located are separated from the plastic plate; and during approaching, the sliding plates where the toothed bars are located are spliced with the plastic plate.

In a preferred technical solution of the present disclosure, the bottom plate is fixed with a plastic limiting block; a lower end of the U-shaped frame has a protruding part; and two sides of the protruding part are in contact with the plastic limiting block.

In a preferred technical solution of the present disclosure, the up-down steadying part includes an inner wall groove and an outer convex bar; an inner hole diameter of an upper end of the protection frame is consistent with an outer diameter of the movable column; the inner wall groove is provided in an inner wall of an inner hole and is not communicated to an upper surface of the protection frame; the outer convex bar is integrally formed on an outer wall of the movable column; and the outer convex bar is arranged in the inner wall groove in a matched manner. Namely, when the movable column moves, since the outer convex bar is arranged in the inner wall groove, the outer convex bar can move up and down only along the inner wall groove. An annular frame body is fixed on a lower surface of the movable column; a plastic protrusion is integrally formed on an inner side of a lower end of the annular frame body; after the annular frame body is buckled on the movable column limiting disk under the action of an external force, an upper surface of the plastic protrusion is in contact with a lower surface of the movable column limiting disk to limit a position of the annular frame body at the movable column limiting disk.

Beneficial effects of the present disclosure are as follows: By the arrangement of the protection frame, the inner wall groove, the movable column, the elliptical holes, the outer convex bar, the column body with the elliptical section, and the helical twisted part, when the mop rod is manually extended downwards to drive the movable column to move downwards, the connecting column with the I-shaped section can be driven to rotate, so that the two sliding plates are spliced with the middle plastic plate under the action of the sliding plate transmission structure; and after the splicing, the mutually staggered flange teeth and plastic plate edge teeth clamp the mopping cloth. On the contrary, the mop rod and the protection frame are held in hands and are pulled in opposite directions, so that the connecting column with the I-shaped section can be driven to rotate reversely, and thus, through the sliding plate transmission structure, the two sliding plates are caused to leave a position for being spliced with the plastic plate; and the mopping cloth is released and is convenient to clean. Compared with traditional bonding using a hook and loop fastener, the method avoids the impact caused by repeated removal on the service life of the mop.

Figure 1:
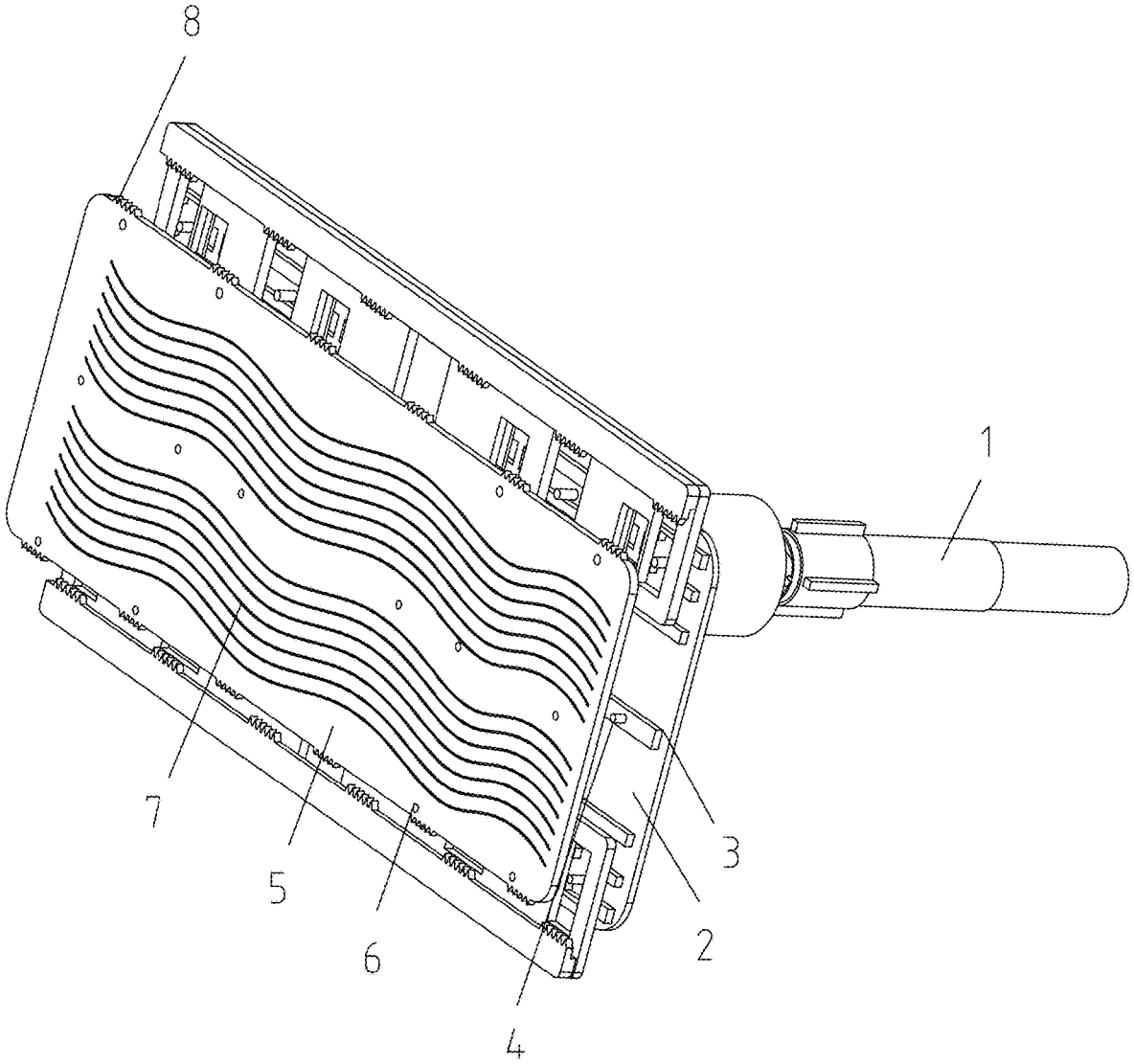
FIG. 1 is a schematic diagram of a lower structure of the present disclosure.

In the drawings: 1: mop rod; 2: bottom plate; 3: convex bar; 4: assembling head; 5: plastic plate; 6: assembling hole; 7: antislip slot; 8: plastic plate edge tooth; 9: sliding plate; 10: sliding plate penetrating slot; 11: steadying plate; 12: steadying slot; 13: outer edge flanges; 14: flange tooth; 15: L-shaped protection plate; 16: transmission matching plate; 161: toothed bar; 17: gear; 18: connecting column with an I-shaped section; 19: through hole; 20: upper fixed plate; 21: plastic limiting plate; 22: U-shaped frame; 23: fixed plate I; 24: matching connecting plate; 25: fixed plate II; 26: movable column limiting disk; 27: protection frame; 28: inner wall groove; 29: movable column; 291: elliptical hole; 301: outer convex bar; 30: column body with elliptical section; and 31: helical twisted part.

DETAILED DESCRIPTION OF THE EMBODIMENTS

Embodiment 1

Figure 2:
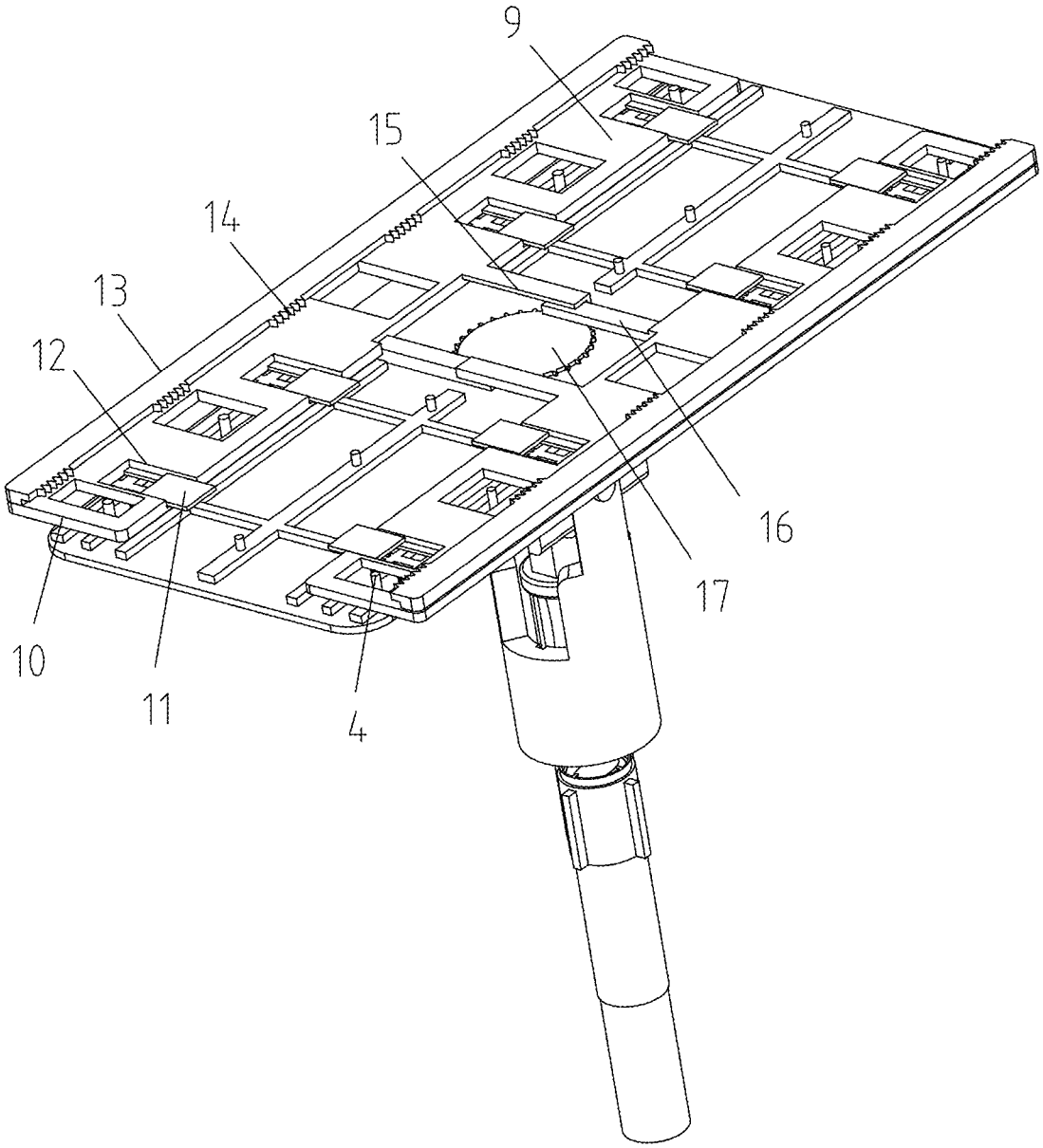
FIG. 2 is a schematic structural diagram of a bottom surface of the present disclosure.
Figure 3:
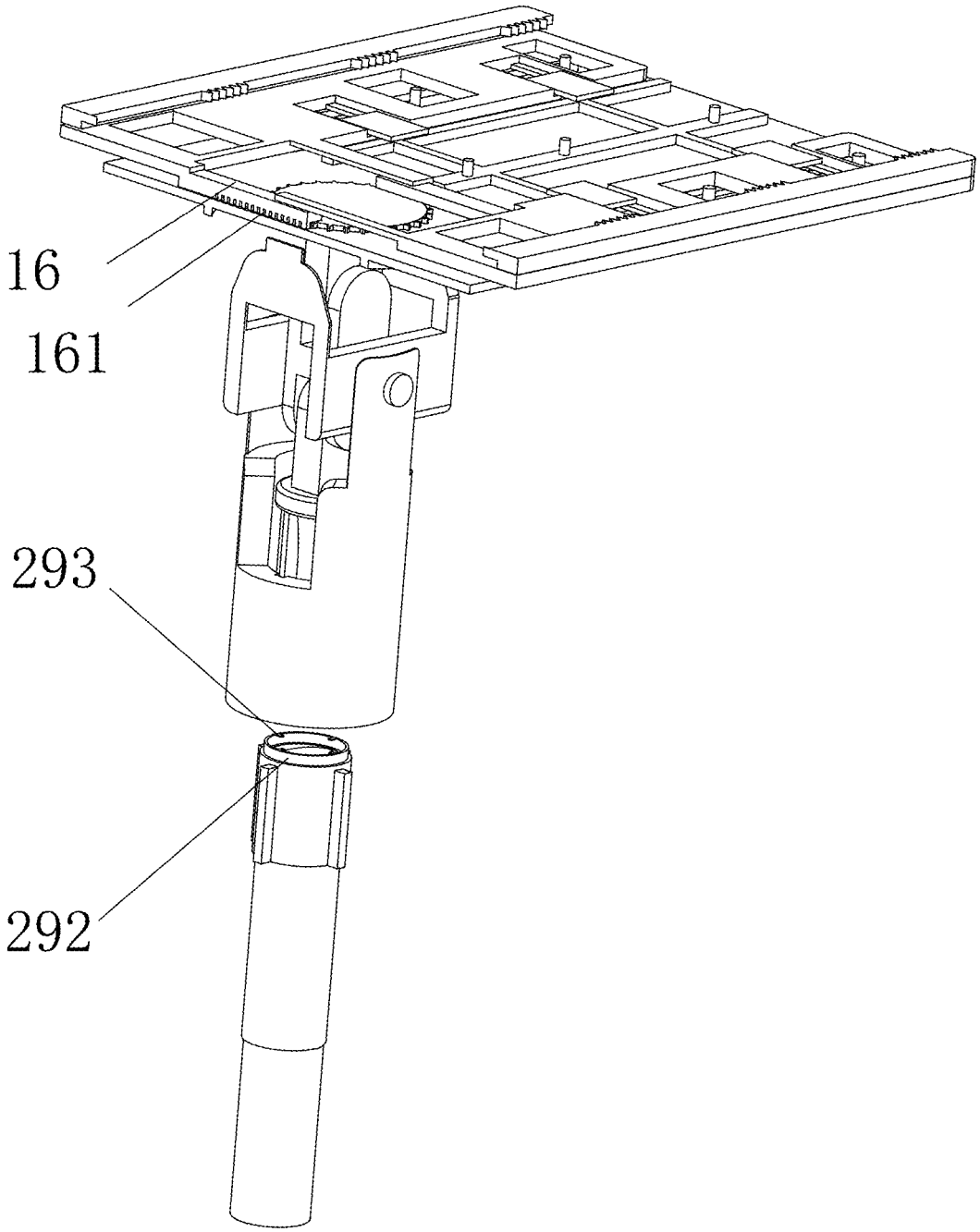
FIG. 3 is a schematic structural diagram of a sectional view of a bottom surface of the present disclosure.
Figure 4:
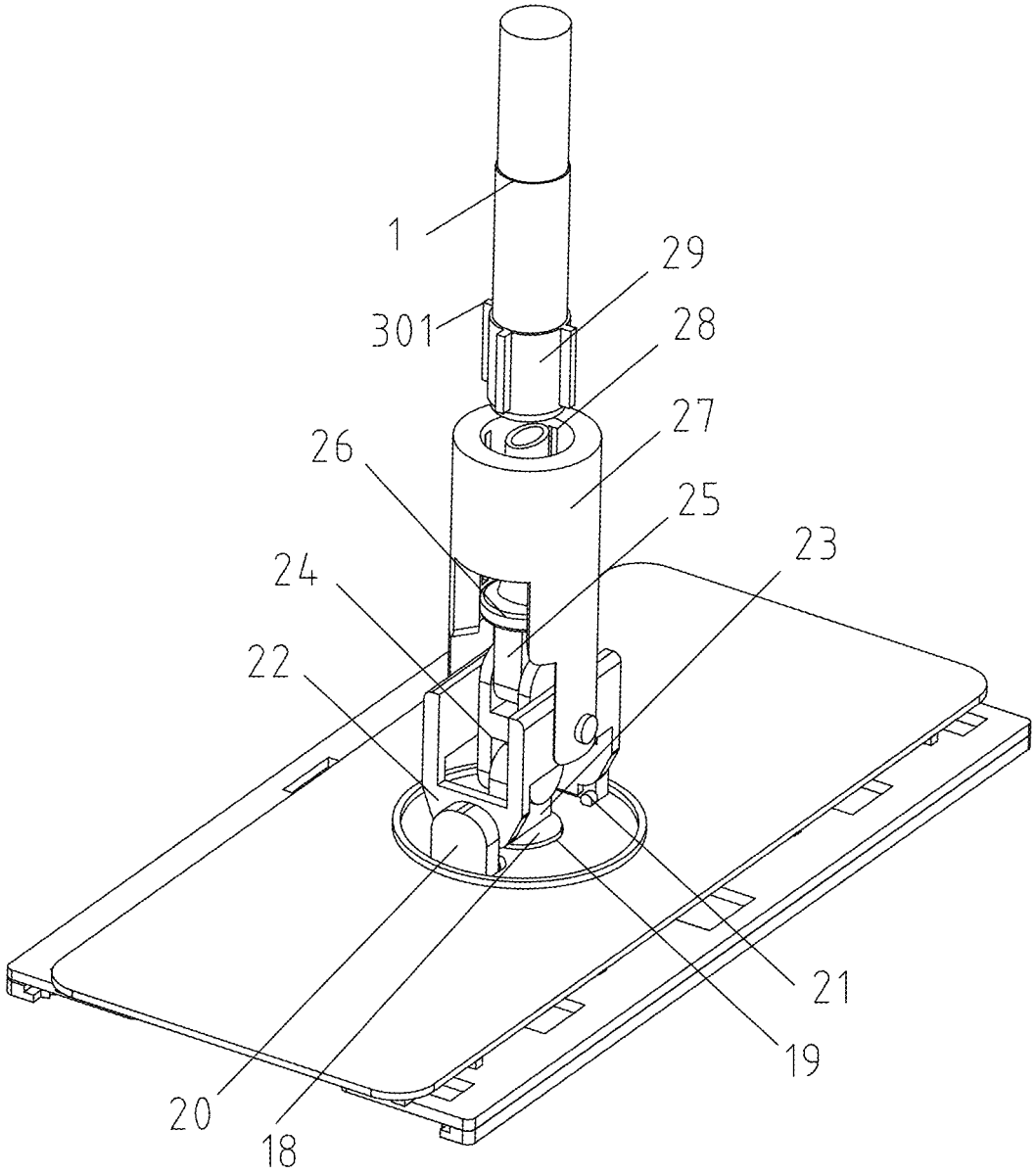
FIG. 4 is a schematic diagram of an upper structure of a bottom plate of the present disclosure.
Figure 5:
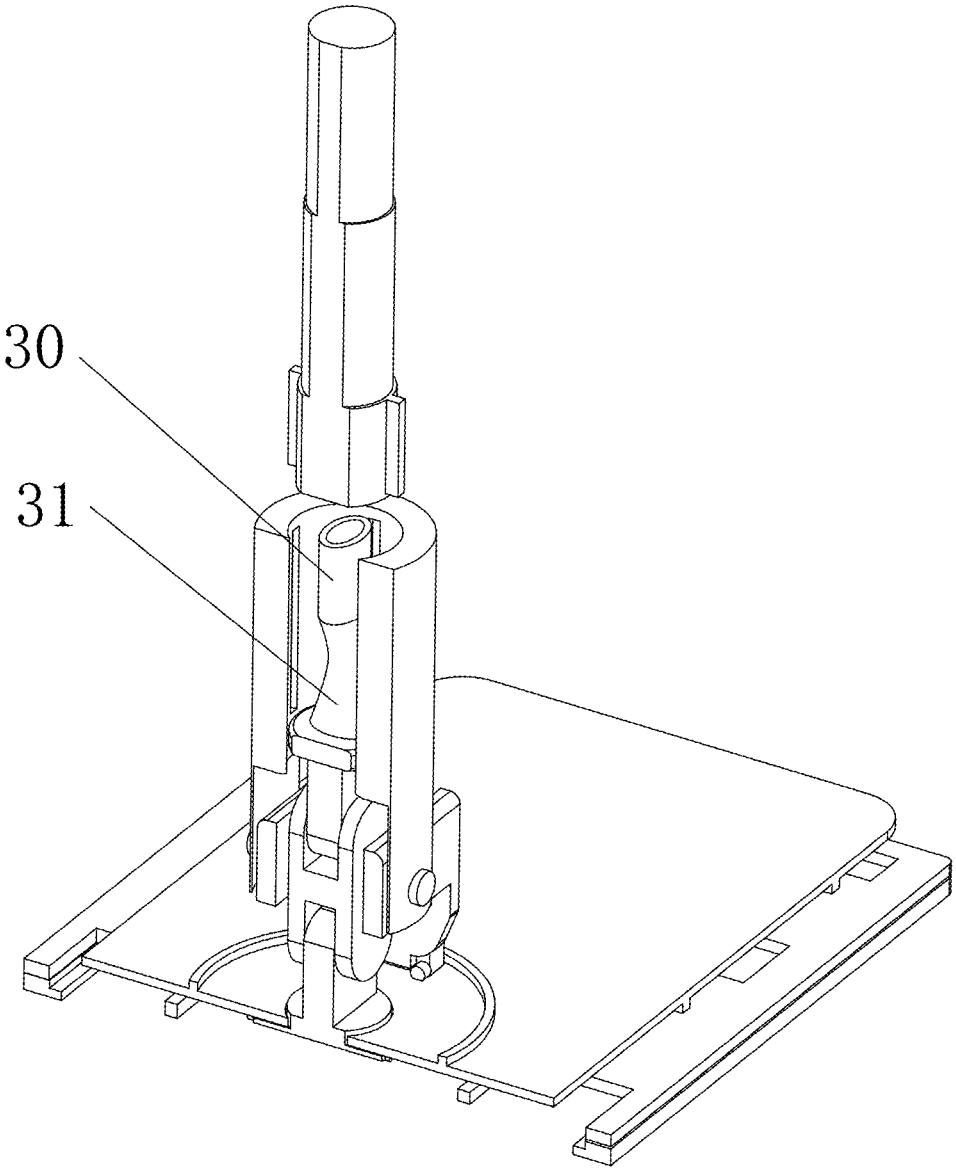
FIG. 5 is a schematic diagram of an upper sectional structure of a bottom plate of the present disclosure.
Figure 6:
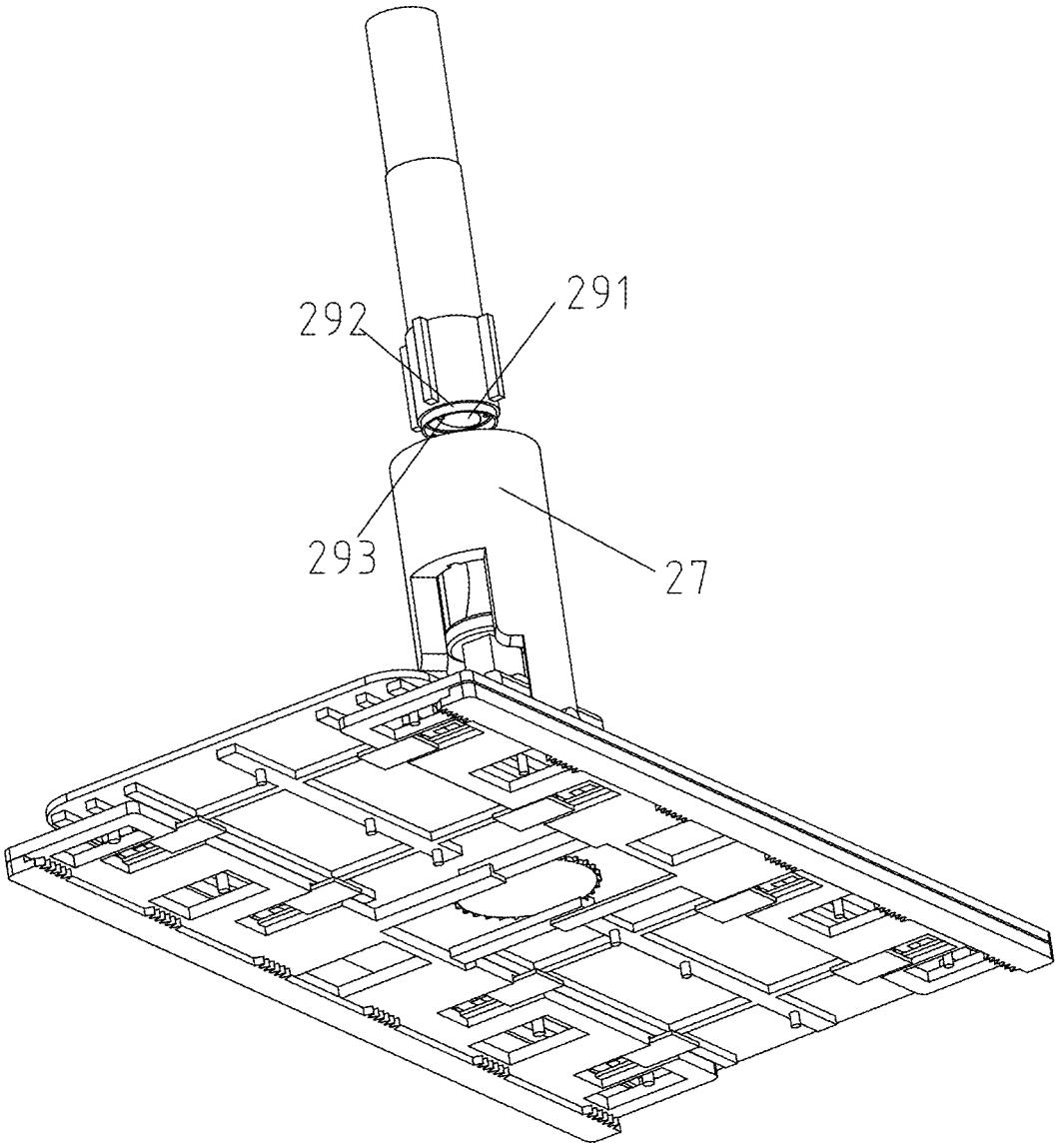
FIG. 6 is a schematic diagram of a bottom sectional view of an upper structure of a bottom plate of the present disclosure.
Figure 7:
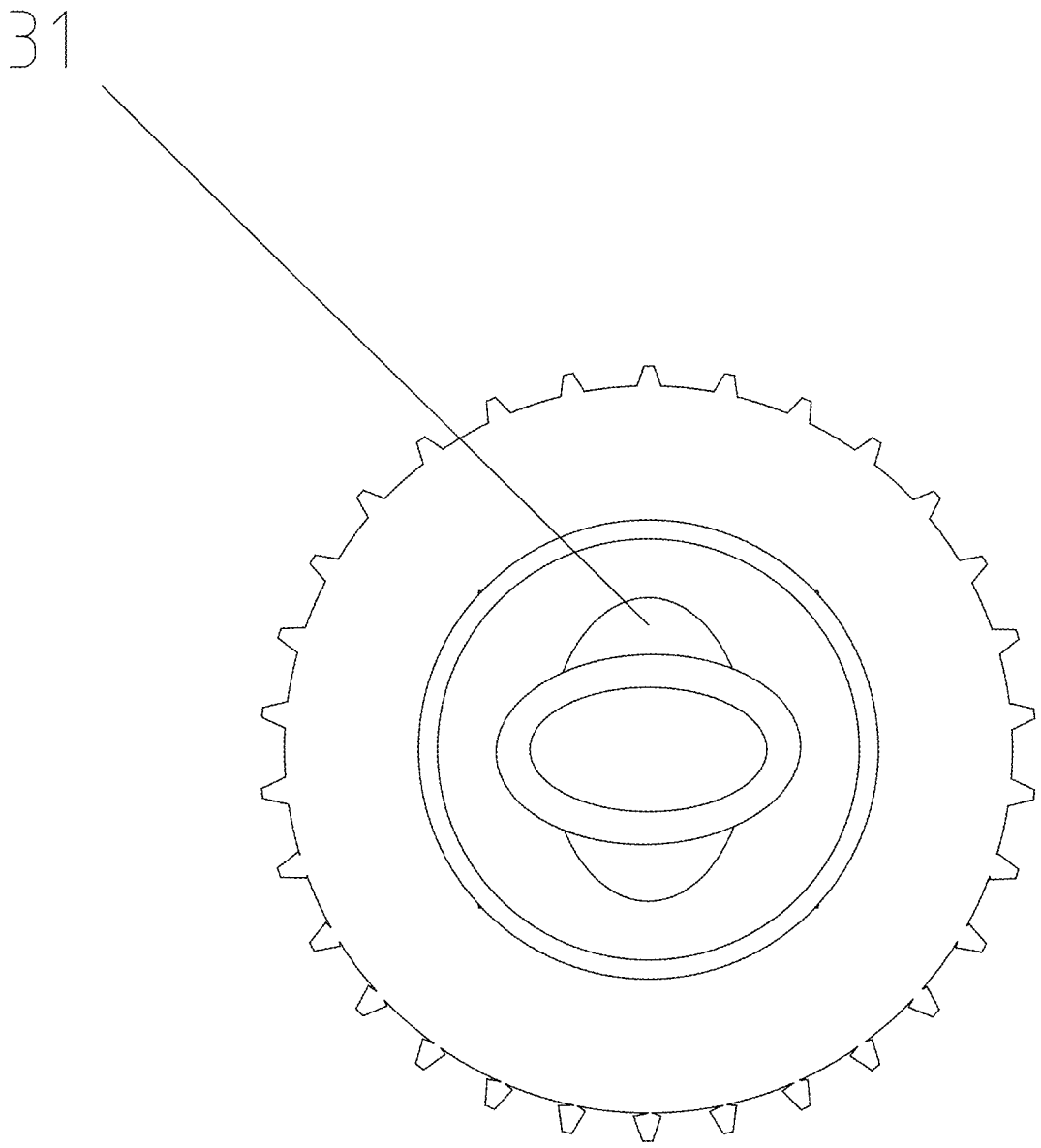
FIG. 7 is a top view of a column body with an elliptical section of the present disclosure.

As shown in FIG. 1 to FIG. 7, the present disclosure provides a mop capable of fixing mopping cloth by push and pull. A technical solution used includes a mop rod 1, and includes a bottom plate 2, several convex bars 3, several assembling heads 4, a plastic plate 5, several assembling holes 6, plastic plate edge teeth 8, sliding plates 9, sliding plate penetrating slots 10, steadying plates 11, steadying slots 12, outer edge flanges 13, flange teeth 14, a sliding plate transmission structure, a connecting column 18 with an I-shaped section, a through hole 19, two upper fixed plates 20, a U-shaped frame 22, a fixed plate I 23, a matching connecting plate 24, a fixed plate II 25, a movable column limiting disk 26, a protection frame 27, an up-down steadying part, a movable column 29, elliptical holes 291, a column body 30 with an elliptical section, and a helical twisted part 31. The several convex bars 3 are distributed on a lower surface of the bottom plate 2; the convex bars 3 are integrally formed with the several assembling heads 4 made of hard plastic; the plastic plate 5 is mounted in a matched manner with the assembling heads 4 through the several assembling holes 6 penetrating through the plastic plate 5; an outer diameter of each assembling head 4 is greater than a hole diameter of each assembling hole 6; the plastic plate edge teeth 8 are integrally formed on side surfaces of the plastic plate 5; the sliding plates 9 are movably arranged below the bottom plate 2; the steadying plates 11 are fixed on the convex bars 3; the steplike steadying slots 12 are provided in the sliding chutes 9; and the steadying plates 11 are inserted in a matched manner into the steplike steadying slots 12. The outer edge flanges 13 are fixed on bottom surfaces, close to outer sides, of the sliding plates 9; the flange teeth 14 are distributed on inner side surfaces of the outer edge flanges 13; the flange teeth 14 are staggered from the plastic plate edge teeth 8; the sliding plate transmission structure is arranged on inner sides of the sliding plates 9; the sliding plate transmission structure is mounted in a matched manner on a bottom surface of the connecting column 18 with the I-shaped section which is mounted in a matched manner in the through hole 19 of the bottom plate 2; and the two upper fixed plates 20 are fixed on the bottom plate 2. Front and rear side walls of the U-shaped frames 22 are rotatably connected to the upper fixed plates 20; and left and right side walls of the U-shaped frames 22 are rotatably connected to the protection frame 27. The fixed plate I 23 is integrally formed on the connecting column 18 with the I-shaped section. The matching connecting plate 24 is provided with open slots in upper and lower ends. An upper end of the fixed plate I 23 is arranged in the open slot in the lower end of the matching connecting plate 24 and is rotatably connected into the slot; a lower end of the fixed plate II 25 is arranged in the open slot in the upper end of the matching connecting plate 24 and is rotatably connected into the slot; and the movable column limiting disk 26 is fixed at an upper end of the fixed plate II (25). The movable column 29 and the protection frame 27 are mounted in a matched manner through the up-down steadying part; the elliptical holes 291 communicated to each other are provided in the mop rod 1 and the movable column 29; the column body 30 with the elliptical section is fixed on the movable column limiting disk 26; and a lower half part of the column body 30 with the elliptical section is the helical twisted part 31, so that an upper elliptical end surface of the column body 30 with the elliptical section and a lower elliptical end surface of the column body 30 with the elliptical section form an angle of 90 degrees.

In a preferred technical solution of the present disclosure, antislip slots 7 are distributed on the plastic plate 5.

In a preferred technical solution of the present disclosure, a setting of the sliding plate transmission structure is as follows: L-shaped protection plates 15 and transmission matching plates 16 are integrally formed on the inner sides of the sliding plates 9; a position of the L-shaped protection plate 15 on a left side corresponds to a position of the transmission matching plate 16 on a right side, and a position of the L-shaped protection plate 15 on the right side corresponds to a position of the transmission matching plate 16 on the left side; the transmission matching plates 16 can extend into openings of the L-shaped protection plates 15; a toothed bar 161 is integrally formed on an upper surface of each of the transmission matching plates 16; the two toothed bars 161 are meshed with the gears 17; and a lower end of the connecting column 18 with the I-shaped section is fixedly connected to the gears 17.

In a preferred technical solution of the present disclosure, the bottom plate 2 is fixed with a plastic limiting block 21; a lower end of the U-shaped frame 22 has a protruding part; and two sides of the protruding part are in contact with the plastic limiting block 21. The U-shaped frame 22 is resisted during rotation. Namely, without an external force, the U-shaped frame 22 can be stabilized in a vertical state. Under an external force, the U-shaped frame 22 can rotate.

In a preferred technical solution of the present disclosure, the up-down steadying part includes an inner wall groove 28 and an outer convex bar 301; an inner hole diameter of an upper end of the protection frame 27 is consistent with an outer diameter of the movable column 29; the inner wall groove 28 is provided in an inner wall of an inner hole; the outer convex bar 301 is integrally formed on an outer wall of the movable column 29; and the outer convex bar 301 is arranged in the inner wall groove 28 in a matched manner. Namely, the movable column 29 can stably vertically move in the protection frame 27, without rotation. An annular frame body 292 is fixed on a lower surface of the movable column 29; a plastic protrusion 293 is integrally formed on an inner side of a lower end of the annular frame body 292; after the annular frame body 292 is buckled on the movable column limiting disk 26 under the action of an external force, an upper surface of the plastic protrusion 293 is in contact with a lower surface of the movable column limiting disk 26 to limit a position of the annular frame body 292 at the movable column limiting disk 26.

The working principle of the present disclosure is as follows: During use, the column body with the elliptical section rotates when the movable column continuously moves downwards and passes through the helical twisted part. When the column body with the elliptical section rotates, the movable column limiting disk, the fixed plate I, the matching connecting plate, and the fixed plate II which are located below the column body with the elliptical section rotate together with the column body with the elliptical section, the connecting column with the I-shaped section can be driven to rotate, thereby driving the gear to rotate, so that the two sliding plates are spliced with the middle plastic plate; and after the splicing, the mutually staggered flange teeth and plastic plate edge teeth clamp the mopping cloth. On the contrary, the mop rod and the protection frame are held in hands and are pulled in opposite directions, so that the connecting column with the I-shaped section can be driven to rotate reversely, and thus, through the reverse rotation of the gears, the two sliding plates are caused to leave a position for being spliced with the plastic plate; and the mopping cloth is released and is convenient to clean. Compared with traditional bonding using a hook and loop fastener, the method avoids the impact caused by repeated removal on the service life of the mop.

The components not detailed herein belong to the prior art.

Although the specific embodiments of the present disclosure have been described in detail above, the present disclosure is not limited to the above embodiments. Within the knowledge scope of a person of ordinary skill in the art, various changes can be made without departing from the principle of the present disclosure, and modifications or transformations that are made without creative labors still fall within the protection scope of the present disclosure.

What is claimed is:

1. A mop capable of fixing mopping cloth by push and pull, comprising a mop rod (1), and comprising a bottom plate (2), several convex bars (3), several assembling heads (4), a plastic plate (5), several assembling holes (6), plastic plate edge teeth (8), sliding plates (9), sliding plate penetrating slots (10), steadying plates (11), steplike steadying slots (12), outer edge flanges (13), flange teeth (14), a sliding plate transmission structure, a connecting column (18) with an I-shaped section, a through hole (19), two upper fixed plates (20), U-shaped frames (22), a fixed plate I (23), a matching connecting plate (24), a fixed plate II (25), a movable column limiting disk (26), a protection frame (27), an up-down steadying part, a movable column (29), elliptical holes (291), a column body (30) with an elliptical section, and a helical twisted part (31), wherein the several convex bars (3) are distributed on a lower surface of the bottom plate (2); the convex bars (3) are integrally formed with the several assembling heads (4) made of hard plastic; the plastic plate (5) is mounted in a matched manner with the assembling heads (4) through the several assembling holes (6) penetrating through the plastic plate (5); an outer diameter of each assembling head (4) is greater than a hole diameter of each assembling hole (6); the plastic plate edge teeth (8) are integrally formed on side surfaces of the plastic plate (5); the sliding plates (9) are movably arranged below the bottom plate (2); the steadying plates (11) are fixed on the convex bars (3); the steplike steadying slots (12) are provided in the sliding plates (9); the steadying plates (11) are inserted in a matched manner into the steplike steadying slots (12); the outer edge flanges (13) are fixed on bottom surfaces, close to outer sides, of the sliding plates (9); the flange teeth (14) are distributed on inner side surfaces of the outer edge flanges (13); the flange teeth (14) are staggered from the plastic plate edge teeth (8); the sliding plate transmission structure is arranged on inner sides of the sliding plates (9); the sliding plate transmission structure is mounted in a matched manner on a bottom surface of the connecting column (18) with the I-shaped section which is mounted in a matched manner in the through hole (19) of the bottom plate (2); the two upper fixed plates (20) are fixed on the bottom plate (2); front and rear side walls of the U-shaped frames (22) are rotatably connected to the upper fixed plates (20); left and right side walls of the U-shaped frames (22) are rotatably connected to the protection frame (27); the fixed plate I (23) is integrally formed on the connecting column (18) with the I-shaped section; the matching connecting plate (24) is provided with open slots in upper and lower ends; an upper end of the fixed plate I (23) is arranged in the open slot in the lower end of the matching connecting plate (24) and is rotatably connected into the slot; a lower end of the fixed plate II (25) is arranged in the open slot in the upper end of the matching connecting plate (24) and is rotatably connected into the slot; the movable column limiting disk (26) is fixed at an upper end of the fixed plate II (25); the movable column (29) and the protection frame (27) are mounted in a matched manner through the up-down steadying part; the elliptical holes (291) communicated to each other are provided in the mop rod (1) and the movable column (29); the column body (30) with the elliptical section is fixed on the movable column limiting disk (26); and a lower half part of the column body (30) with the elliptical section is the helical twisted part (31), so that an upper elliptical end surface of the column body (30) with the elliptical section and a lower elliptical end surface of the column body (30) with the elliptical section form an angle of 90 degrees.

2. The mop capable of fixing mopping cloth by push and pull according to claim 1, wherein antislip slots (7) are distributed on the plastic plate (5).

3. The mop capable of fixing mopping cloth by push and pull according to claim 1, wherein the sliding plate transmission structure comprises L-shaped protection plates (15), transmission matching plates (16), toothed bars (161), and gears (17); the L-shaped protection plates (15) and the transmission matching plates (16) are integrally formed on the inner sides of the sliding plates (9); a position of the L-shaped protection plate (15) on a left side corresponds to a position of the transmission matching plate (16) on a right side, and a position of the L-shaped protection plate (15) on the right side corresponds to a position of the transmission matching plate (16) on the left side; the transmission matching plates (16) extend into openings of the L-shaped protection plates (15); the toothed bars (161) are integrally formed on upper surfaces of the transmission matching plates (16); the two toothed bars (161) are meshed with the gears (17); and a lower end of the connecting column (18) with the I-shaped section is fixedly connected to the gears (17).

4. The mop capable of fixing mopping cloth by push and pull according to claim 1, wherein the bottom plate (2) is fixed with a plastic limiting block (21); a lower end of the U-shaped frame (22) has a protruding part; and two sides of the protruding part are in contact with the plastic limiting block (21).

5. The mop capable of fixing mopping cloth by push and pull according to claim 1, wherein the up-down steadying part comprises an inner wall groove (28) and an outer convex bar (301); an inner hole diameter of an upper end of the protection frame (27) is consistent with an outer diameter of the movable column (29); the inner wall groove (28) is provided in an inner wall of an inner hole; the outer convex bar (301) is integrally formed on an outer wall of the movable column (29); and the outer convex bar (301) is arranged in the inner wall groove (28) in a matched manner.

6. The mop capable of fixing mopping cloth by push and pull according to claim 1, wherein an annular frame body (292) is fixed on a lower surface of the movable column (29); a plastic protrusion (293) is integrally formed on an inner side of a lower end of the annular frame body (292); when the annular frame body (292) is buckled on the movable column limiting disk (26) under the action of an external force, an upper surface of the plastic protrusion (293) is in contact with a lower surface of the movable column limiting disk (26) to limit a position of the annular frame body (292) at the movable column limiting disk (26).

* * * * *